US007726403B2

(12) United States Patent
Surjaatmadja

(10) Patent No.: US 7,726,403 B2
(45) Date of Patent: Jun. 1, 2010

(54) APPARATUS AND METHOD FOR RATCHETING STIMULATION TOOL

(75) Inventor: Jim B. Surjaatmadja, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 2 days.

(21) Appl. No.: 11/977,772

(22) Filed: Oct. 26, 2007

(65) Prior Publication Data

US 2009/0107680 A1 Apr. 30, 2009

(51) Int. Cl.
*E21B 43/267* (2006.01)

(52) U.S. Cl. ..... 166/308.1; 166/177.5; 166/223; 166/280.1

(58) Field of Classification Search ..... None
See application file for complete search history.

(56) References Cited

U.S. PATENT DOCUMENTS

| | | | | |
|---|---|---|---|---|
| 3,764,168 | A | 10/1973 | Kisling, III et al. | |
| 4,625,799 | A | 12/1986 | McCormick et al. | |
| 4,799,554 | A | 1/1989 | Clapp et al. | |
| 5,494,103 | A | 2/1996 | Surjaatmadja et al. | |
| 5,499,678 | A | 3/1996 | Surjaatmadja et al. | |
| 5,533,571 | A | 7/1996 | Surjaatmadja et al. | |
| 5,765,642 | A | 6/1998 | Surjaatmadja | |
| 5,826,661 | A | 10/1998 | Parker et al. | |
| 5,845,711 | A | 12/1998 | Connell et al. | |
| 5,980,446 | A * | 11/1999 | Loomis et al. | 588/250 |
| 6,119,783 | A | 9/2000 | Parker et al. | |
| 6,286,599 | B1 | 9/2001 | Surjaatmadja et al. | |
| 6,662,874 | B2 | 12/2003 | Surjaatmadja et al. | |
| 6,712,134 | B2 | 3/2004 | Stoesz | |
| 6,938,690 | B2 | 9/2005 | Surjaatmadja | |
| 6,948,561 | B2 | 9/2005 | Myron | |
| 7,159,660 | B2 | 1/2007 | Justus | |
| 7,168,493 | B2 | 1/2007 | Eddison | |
| 2005/0145384 | A1 * | 7/2005 | Jasser et al. | 166/278 |
| 2006/0070740 | A1 | 4/2006 | Surjaatmadja et al. | |
| 2006/0090900 | A1 * | 5/2006 | Mullen et al. | 166/376 |

FOREIGN PATENT DOCUMENTS

| | | | |
|---|---|---|---|
| WO | WO 02/075104 | A1 | 9/2002 |
| WO | 2005090747 | A1 | 9/2005 |

OTHER PUBLICATIONS

Halliburton Communications Catalog, "SurgiFrac Service—Fracture Stimulation Technique for Horizontal Completions in Low-to-Medium Permeability Reservoirs," HO3392, May 2005.

SPE 107718, Jim B. Surjaatmadja, "Single Point of Initiation, Dual-Fracture Placement of Maximizing Well Production," Scheveningen, The Netherlands, May 30-Jun. 1, 2007.

* cited by examiner

*Primary Examiner*—Zakiya W. Bates
(74) *Attorney, Agent, or Firm*—John W. Wustenberg; McAfee & Taft

(57) ABSTRACT

A method and apparatus for ratcheting a stimulation tool in a well in which the stimulation tool is movable from a first radial position to a second radial position without moving the tool string.

24 Claims, 6 Drawing Sheets

APPARATUS AND METHOD FOR RATCHETING STIMULATION TOOL

BACKGROUND

This disclosure relates to a system for treating a subterranean well formation to stimulate production, and more particularly to an apparatus and method for fracturing.

Hydraulic fracturing is used often to stimulate production of hydrocarbons from formations penetrated by the wells. Typically, a well casing, if present, will be perforated adjacent the zone to be treated. Several zones may be treated, and a zone may comprise a formation, or several zones may be treated in a single formation. After the casing is perforated, a fracturing fluid is pumped into the well through the perforations so that fractures are formed and extended in the formation. Propping agents suspended in the fracturing fluid will be deposited in the fractures to prevent the fractures from closing.

One method for fracturing involves using a jetting tool with jets, or ports, therethrough which can be used to initiate and extend fractures in a zone. It is often desirable to rotate the jetting tool so that fluid pumped through the jets acts on a zone at the same, or near the same longitudinal or axial location in the well but at a different radial location. In other words, fluid will be pumped through the jets to act on a zone in the well, and the tool will be rotated so that the jets are oriented at a different radial location in the well, but may be at the same or near the same axial location in the well.

Typically, to rotate the jetting tool, the entire tool string must be moved. As such, it is difficult, time-consuming, and sometimes not possible to rotate the jetting tool and accurately position the jetting tool radially and axially in the well. A tool that can be consistently and accurately rotated and positioned in a well for accurate placement of fractures is desirable.

SUMMARY

A stimulation tool for treating zones intersected by a wellbore is disclosed. The stimulation tool may be lowered into the well on a tool string. The stimulation tool comprises a sealed sub, or outer housing with a jetting tool movable relative thereto. The jetting tool comprises a stem slidably disposed in the sealed sub with a jetting head connected at an end of the stem. The jetting tool is thus movable relative to the outer housing and to the tool string on which the stimulation tool is lowered.

The stimulation tool is lowered into the well and is positioned adjacent a zone to be treated. The jetting tool is axially extended by applying hydraulic pressure with fluid through the tool string. The jetting tool will rotate simultaneous to its axial movement and will be positioned adjacent a first radial position in the well to be treated. The treatment may comprise, for example, pumping a proppant-laden fluid through the jetting head which may perforate any casing in the well and will initiate and begin to extend fractures in the zone. The jetting head preferably has ports with nozzles therein so that adequate velocity may be generated to perforate a casing if necessary and to initiate and extend fractures. An annulus fluid may be pumped in an annulus between the tool string and the well to aid in extending the fractures. The annulus fluid may be for example a clean fluid. Fractures may be created and extended further by, for example, pushing the proppant-laden fluid into the zone with a clean fluid behind the proppant-laden fluid, in the tool string which may be referred to as a pad. Thereafter, a proppant-laden fluid may be forced into the zone through the annulus or behind the pad in the tool string and through the jets. If the proppant-laden fluid is utilized in the annulus, it is preferred that a clean fluid continue to be pumped through the jetting tool. Likewise, if a proppant-laden fluid follows the clean fluid in the tool string, it is preferred that the annulus fluid be a clean fluid with no proppant therein.

Once treatment at the first radial location is completed, the jetting tool is ratcheted so that it is positioned in a second radial location. The ratcheting involves relieving pressure in the tool string such that the jetting tool will axially retract and will simultaneously rotate to a retracted position. Hydraulic pressure is then applied by increasing the fluid flow into the jetting head to a sufficient level such that the jetting head will axially extend and will simultaneously rotate to the second radial position where treatment can then be applied. The treatment may be, for example, that described herein such that fractures are initiated and created at the second radial location. The jetting tool will move automatically from the extended to the retracted position upon the release of hydraulic pressure. The jetting tool is urged toward the retracted position by a spring disposed about the stem.

If desired, several zones which may be several zones in a formation or which may be separate formations may be treated in the manner described herein.

DETAILED DESCRIPTION OF THE PREFERRED EMBODIMENTS

Figure 1:
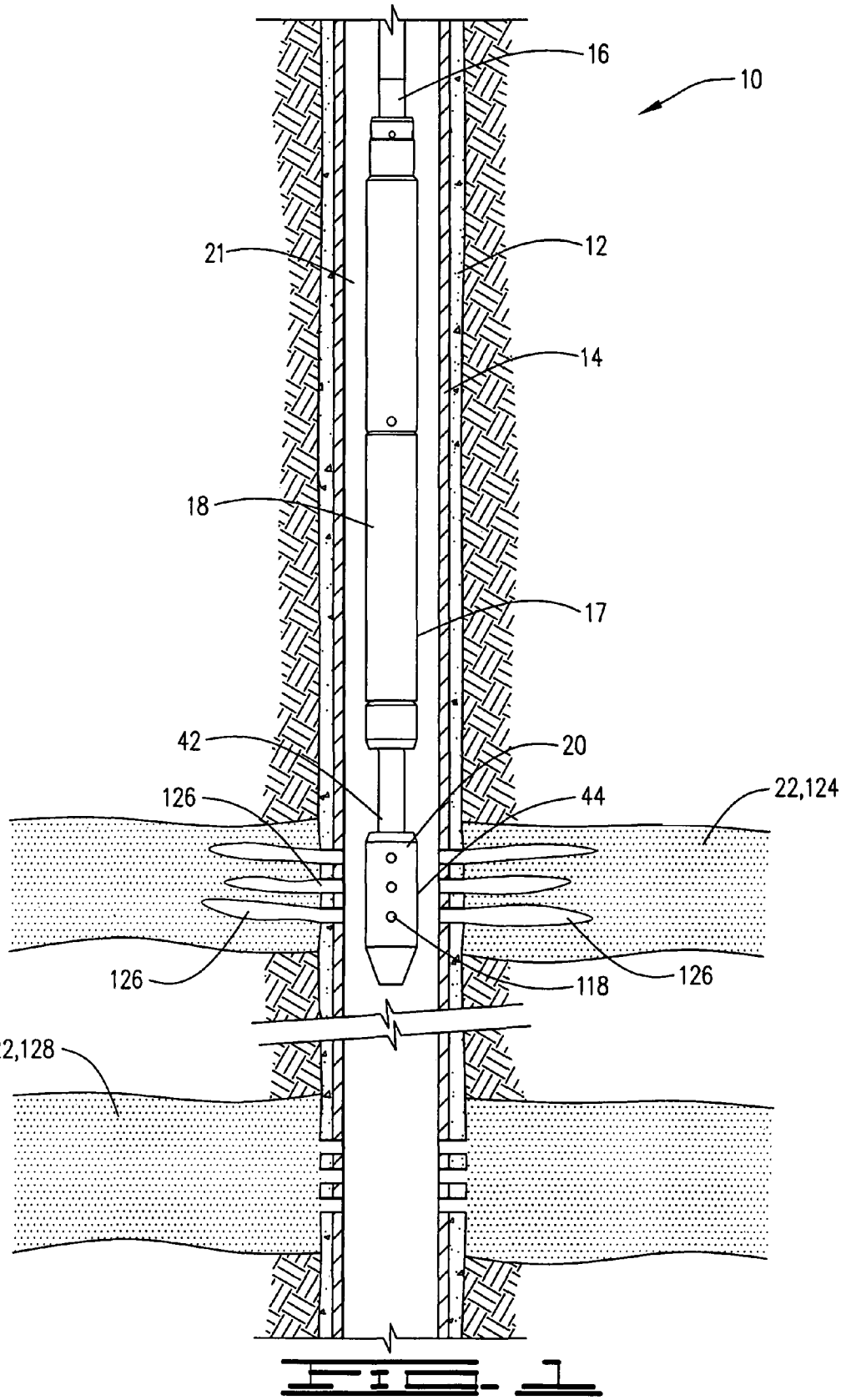
FIG. 1 schematically shows a stimulation tool disposed in a well.

Referring to the figures, and more particularly to FIG. 1, a well 10 comprising a wellbore 12, with a casing 14 cemented therein, is shown. A tool string 16 is shown positioned in well 10. Tool string 16 includes stimulation tool 17, which may comprise housing, or sealed sub 18 with jetting tool 20 extending therefrom. In FIG. 1, jetting tool 20 is positioned adjacent one of a plurality of formations, or zones, 22 intersected by well 10. It is understood that while stimulation tool 17 is shown in cased well 10, it may be used in open wellbores as well. Tool string 16 and casing 14 define annulus 21 therebetween.

Figure 2A:
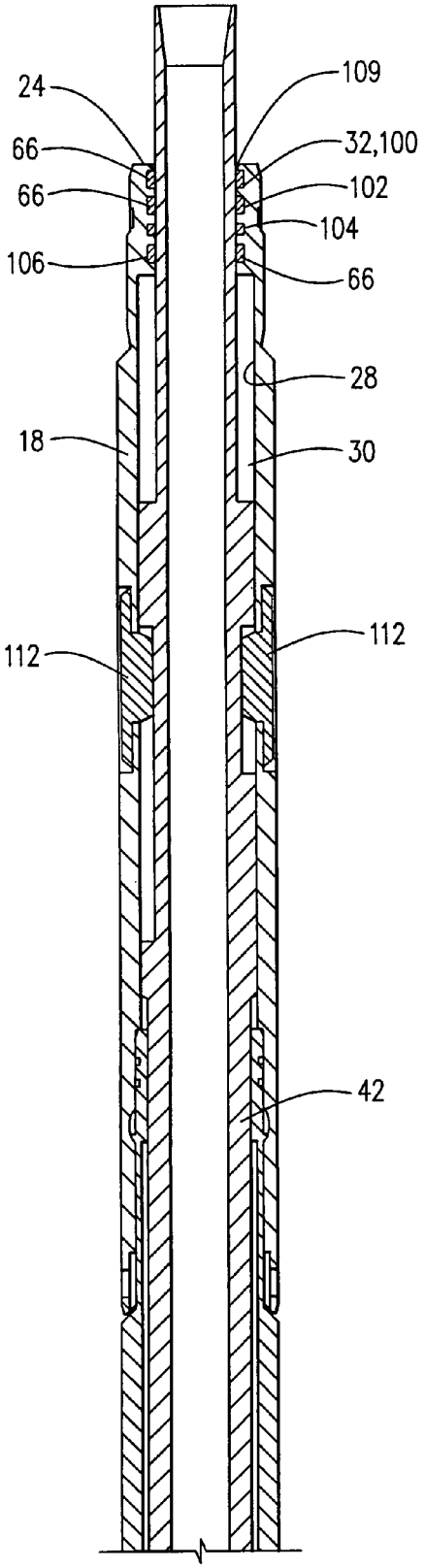
FIGS. 2A and 2B are side cross-sectional views of the tool in an extended position to the inventive tool.
Figure 2B:
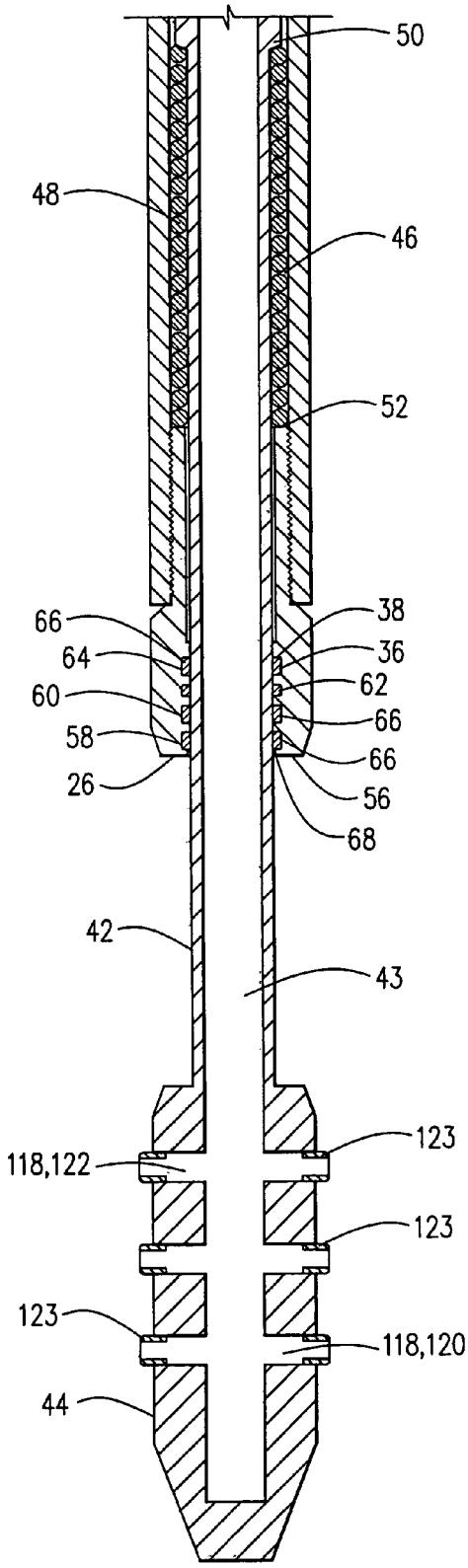
Figure 3A:
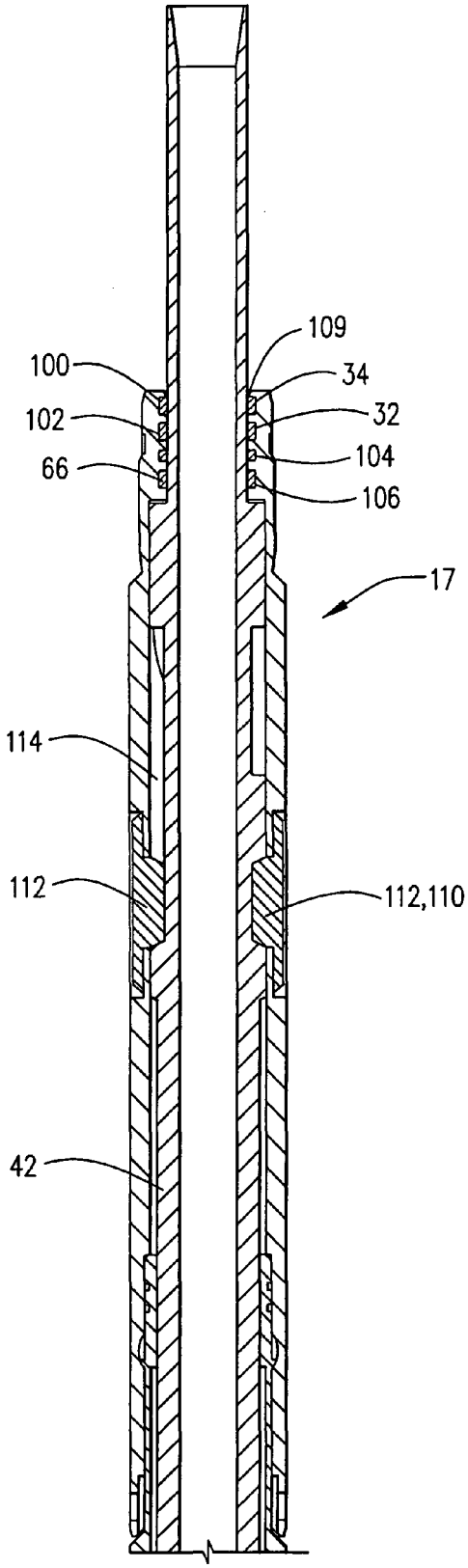
FIGS. 3A and 3B are side cross-sectional views of the tool in a retracted position to the inventive tool.
Figure 3B:
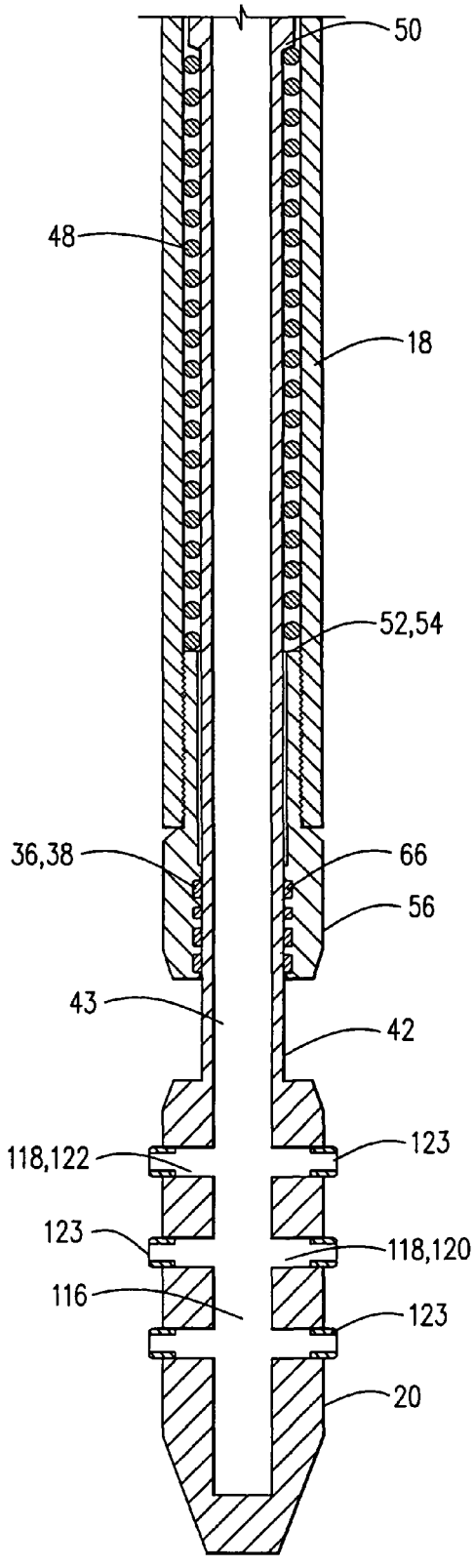
Figure 4:
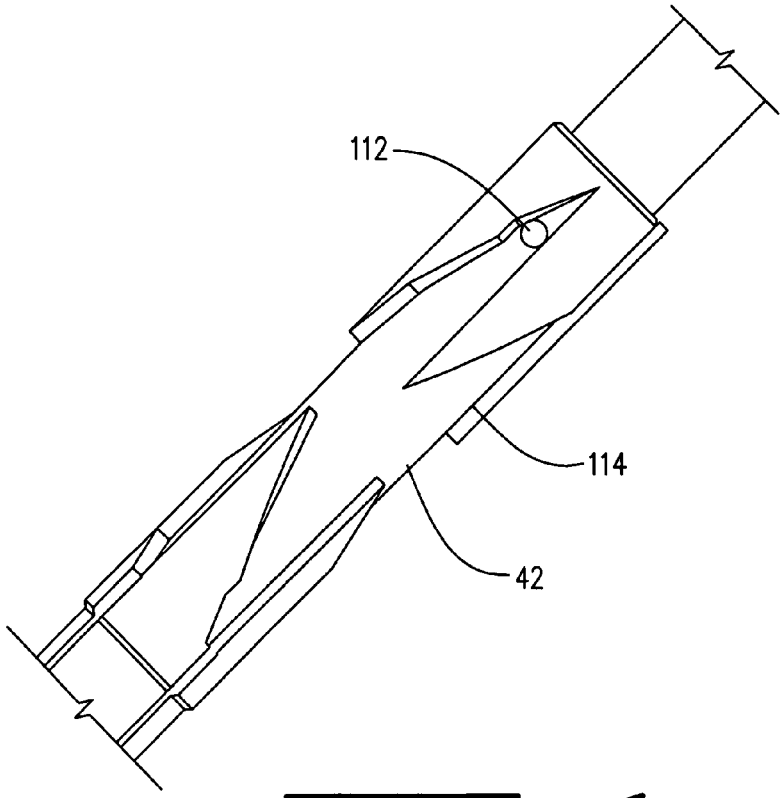
FIG. 4 is a perspective view of the stem of the tool.

Referring to FIGS. 2 and 3, sealed sub 18 comprises upper end 24 and lower end 26. Sealed sub 18 has an inner surface 28 defining sub passage 30 therethrough. Sealed sub 18 defines at least one, and preferably a plurality of upper grooves or channels 32 with at least one, and preferably a plurality of upper seals 34 disposed therein. Sealed sub 18 has at least one, and preferably a plurality of lower channels 36 having at least one, and preferably a plurality of lower seals 38 disposed therein. Upper and lower seals 34 and 38 are described in more detail hereinbelow. Jetting tool 20, which comprises stem 42 and jetting head 44, is slidably disposed in sealed sub 18. Stem 42 defines a stem passage 43 therethrough. Stem 42, and thus jetting tool 20, is slidable relative to sealed sub 18, and is rotatable relative thereto. Upper and lower seals 34 and 38 sealingly engage stem 42, so that stem 42 and sealed sub 18 define a sealed, oil-filled cavity 46.

A spring 48 is disposed about stem 42 in cavity 46, and is positioned between a shoulder 50, referred to herein as upper shoulder 50, defined on stem 42, and a lower shoulder 52. Lower shoulder 52 may be defined by an upper end 54 of a threaded lower end cap 56. Threaded lower end cap 56 comprises lower end 26 of sealed sub 18, and lower seals 38 are disposed in threaded lower end cap 56. Spring 48 biases stem 42 upwardly, as viewed in FIGS. 2A and 2B, to urge jetting tool 20 from its second, or extended position shown in FIGS. 2A and 2B, to its first, or retracted position shown in FIGS. 3A and 3B.

The plurality of lower channels 36 comprise a lowermost channel 58 which may be referred to as first lower channel 58, and second, third and fourth lower channels 60, 62 and 64, respectively. Lowermost channel 58 has a wiper seal 66 disposed therein. Sealed sub 18 and stem 42 define a gap 68 therebetween at lower end 26 of sealed sub 18 so that well 10 communicates with channel 58 through gap, or passageway 68.

Wiper seal 66 comprises body 70, with a cutaway portion 72 to define inner and outer wipers 74 and 76. Wiper seal 66 has inner side 78 and outer side 80. Wiper segments 82 and 84, respectively, that angle outwardly from generally vertical segments 81 and 83 define wipers 74 and 76. Cutaway portion 72 comprises an arcuate cutout 86, which may generally be a semicircular cutout 86 with ends 88 and 90. Cutaway portion 72 has angularly outwardly extending segments 92 and 94, which extend angularly outwardly from ends 88 and 90, and along with segments 82 and 84 define wipers 74 and 76.

A wiper seal 66 is positioned in lowermost channel 58 so that cutaway portion 72 faces downwardly toward passageway 68 and well 10. In the embodiment shown, a wiper seal 66 is also positioned in channel 60 and is oriented identically to the wiper seal in channel 58. Seals 66 are elastomeric, but may be formed of any seal material capable of withstanding downhole environments.

An O-ring seal 96 is disposed in channel 62, and a third wiper seal 66 is positioned in channel 64. The wiper seal positioned in channel 64 has cutaway portion 72 facing upwardly, toward oil-filled cavity 46. Thus, in the embodiment shown, the plurality of seals 38 comprise the three wiper seals 66 and one O-ring 96. Wiper seals 66 are compressed in channels 58, 60 and 64 between sealed sub 18 and stem 42, and sealingly engage both.

The seal arrangement at upper end 24 of sealed sub 18 is a mirror image of the arrangement at lower end 26. Upper channels 32 may therefore comprise an uppermost channel 100, which may be referred to as a first upper channel 100, and second, third and fourth upper channels 102, 104 and 106, respectively. Wiper seals 66, positioned so that the cutaway portion 72 faces upwardly toward well 10 are disposed in channels 100 and 102 and a wiper seal 66 is positioned in channel 106 and faces downwardly, towards oil-filled cavity 46. An O-ring seal 96 is disposed in third upper channel 104. The plurality of seals 34 thus comprises the three wiper seals 66 and an O-ring seal 96. A gap, or passageway 109, similar to gap 68 at lower end 26 of sealed sub 18, is defined by sealed sub 18 and jetting tool 20 at upper end 24 of sealed sub 18. Well 10 communicates with uppermost channel 100 through passageway 109.

Figure 5:
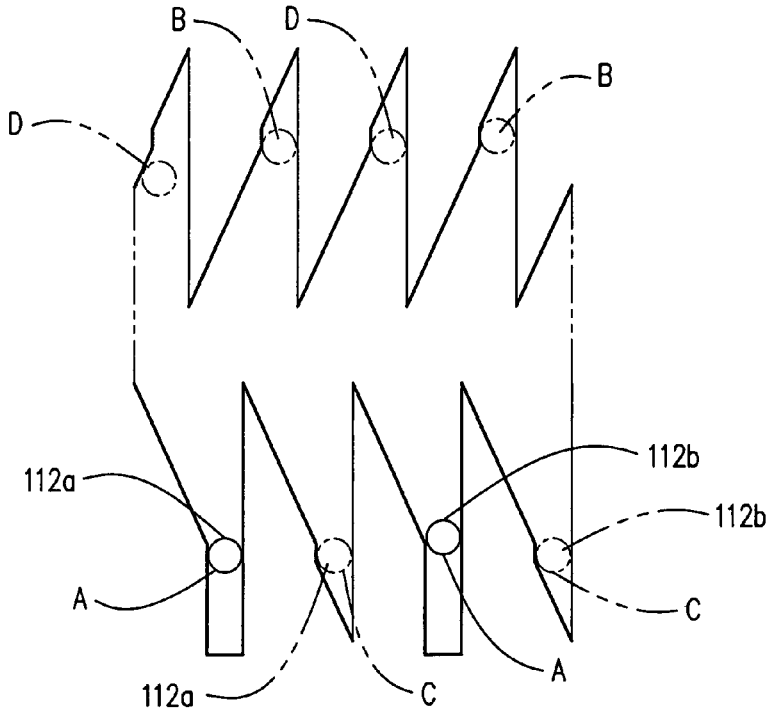
FIG. 5 is a rolled-out exterior view of the stem of the tool.
Figure 6:
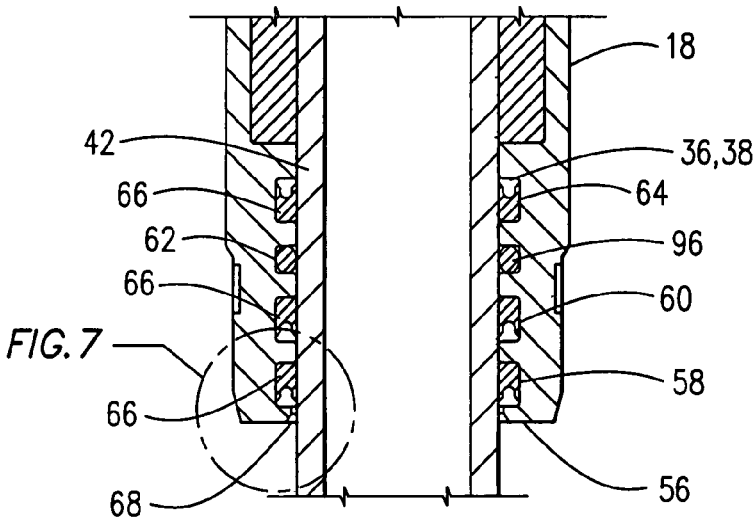
FIG. 6 is a cross-sectional view of the lower end of the tool.
Figure 7:
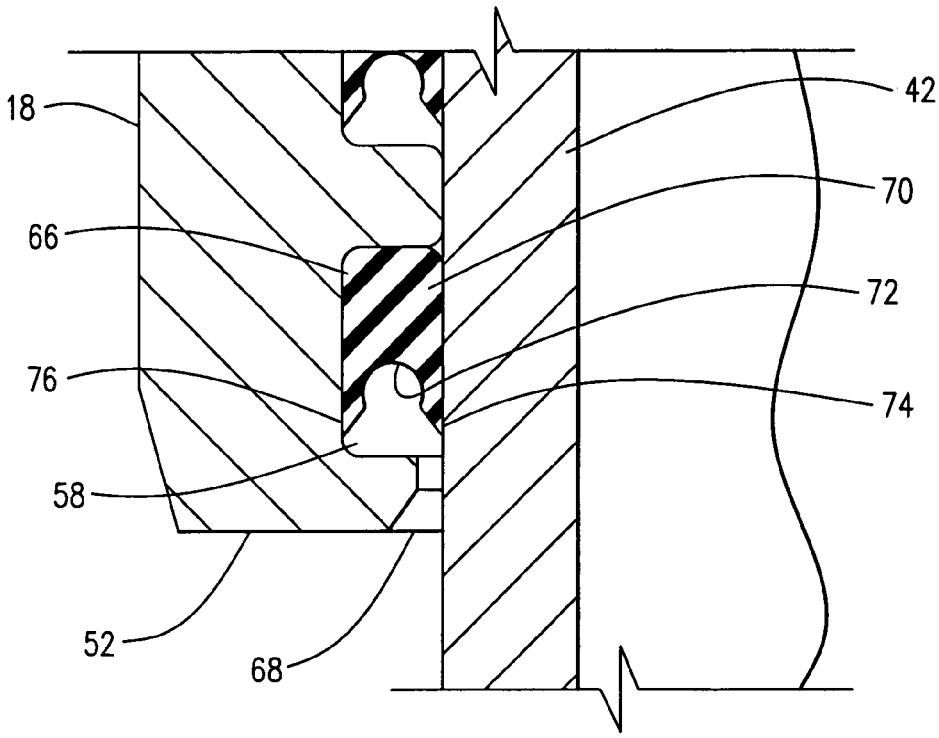
FIG. 7 is a detail view from FIG. 6 showing the gap between the stem and the housing, and showing seals installed in grooves in the housing.
Figure 8:
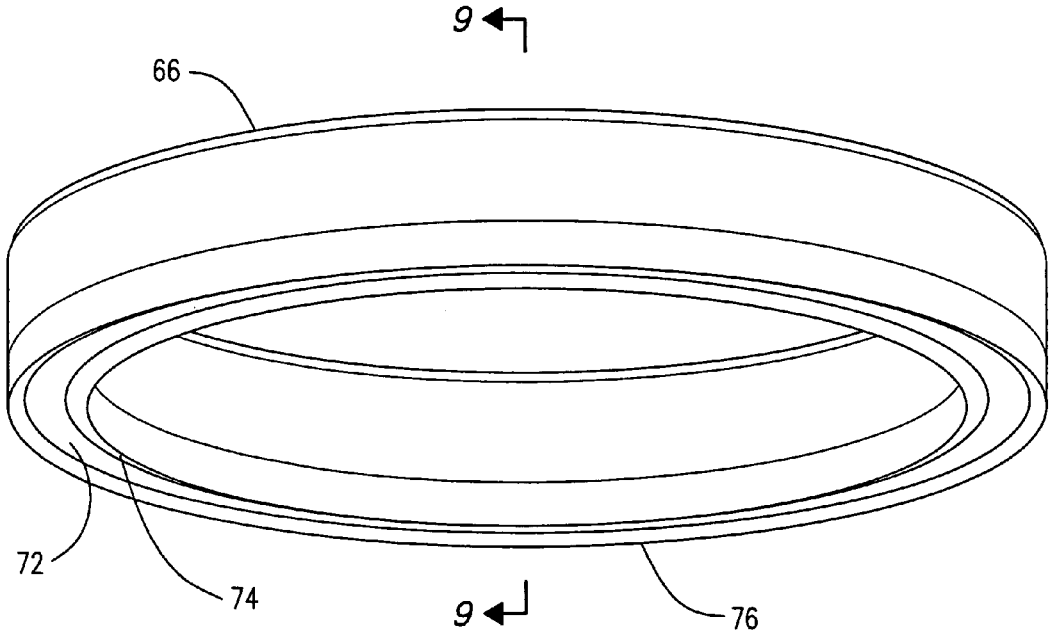
FIG. 8 is a perspective view of a wiper seal.
Figure 9:
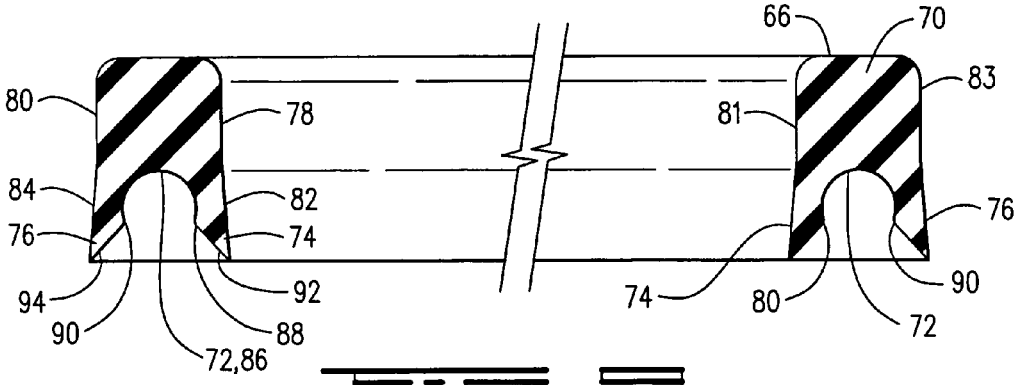
FIG. 9 is a cross-sectional view of the wiper seal taken along line 9-9.

Stimulation tool 17 includes a ratchet 110. Ratchet 110 comprises at least one, and preferably a pair of lugs 112 affixed to sealed sub 18, and a J-slot 114 in stem 42. Lugs 112 may be welded, or affixed by other means known in the art to sealed sub 18. J-slot 114, which is laid out in FIG. 5, may be machined or otherwise formed in the stem 42, or may be machined or formed in a separate collar that is attached to stem 42.

Lugs 112 may be referred to as lugs 112*a* and 112*b* which are positioned 180° apart. Stem 42 is movable relative to sealed sub 18, and ratcheting occurs when stem 42 is reciprocated axially relative to sealed sub 18, and the reciprocating motion causes stem 42 to rotate relative to sealed sub 18.

The axial motion of stem 42 relative to sealed sub 18, and the rotation of stem 42 relative to sealed sub 18 occur solely upon the application and relief of hydraulic pressure, due to fluid flow in tool string 16 into and through jetting tool 20.

Jetting head 44 has central passage 116 which is communicated with stem passage 43, and a plurality of ports 118 intersecting central passage 116, so that fluid may be communicated therethrough into well 10. Ports 118 comprise a first set of ports 120, and a second set of ports 122. In the embodiment shown, the ports in each of first and second sets 120 and 122 are axially aligned, and first set 120 is positioned 180° from second set 122. Each of ports 118 may have a nozzle 123 therein such that ports 118 comprise jets, or jetting ports for jetting fluid into well 10. Other port positions and orientations may be used.

In operation, tool string 16 with stimulation tool 17 is lowered into well 10 and positioned adjacent a first zone, for example first zone 124, to be treated. Fluid may be circulated into well 10 as tool string 16 is lowered therein. As stimulation tool 17 is lowered into well 10, lugs 112*a* and 112*b* will be positioned as shown by the solid lines in FIG. 5 and designated as position A in which stimulation tool 17 is in its retracted position. Once stimulation tool 17 reaches the desired position in the well adjacent first zone 124, fluid flow is increased inside tool string 16 such that a sufficient hydraulic pressure is applied to cause jetting tool 20 to move axially relative to sealed sub 18.

The axial reciprocation will cause rotation of jetting tool 20 relative to sealed sub 18 as lugs 112*a* and 112*b* engage J-slot 114 and move from the position designated by the capital letter A to the position designated by the capital letter B. The axial motion and the rotation is thus caused solely by hydraulic pressure in the tool string which acts upon jetting tool 20 to move jetting tool 20 relative to sealed sub 18. Fluid is pumped from tool string 16 through stem passage 43, central passage 116 of jetting head 44, and through jetting ports 118 to perforate casing 14 in well 10 and to initiate and extend fractures in zone 124. As explained above, the embodiment shown includes casing 14 but the method and tool described herein may be used in open uncased holes as well. The initial fluid pumped through jetting tool 20 comprises a first tubing fluid which is preferably a proppant-laden fluid. Well 10 may also have an initial annulus fluid which may be referred to as a first annulus fluid therein that fills annulus 21. The initial annulus fluid is preferably a clean fluid with no proppant, but may be otherwise.

Pressure may be applied to the first annulus fluid so that pressure is applied to zone 124 both by the first annulus fluid and the first tubing fluid jetted through ports 120 and 122. In one embodiment, fractures may be further extended with a pad or a second tubing fluid behind the proppant-laden fluid in the tool string 16. Pressure will continue to be applied by the first annulus fluid. After the pad is pumped through the tool string 16, treatment may continue. For example, a third annulus fluid, such as for example clean fluid may be pumped down tool string 16 while a proppant-laden fluid is pumped into annulus 21 to continue to extend fractures. If desired, a different method may be utilized so that a clean fluid is pumped in the annulus but a proppant-laden fluid is pumped through the jetting tool 20 after the pad.

In FIG. 1, the fractures 126 schematically represent fractures that may occur during treatment at a first radial position in the well in the desired zone, in this case zone 124. Once that treatment is complete, jetting tool 20 may be rotated to a new or second radial position reflected in FIG. 1 by the position of the jetting head 44 in which the jetting ports 118 are shown perpendicular to the plane of the page. To rotate from the first radial position to the second radial position, which is 90° from the first radial position, pressure in the tool string 16 is relieved to allow jetting head 20 to move upwardly relative to sealed sub 18 to the retracted position and to rotate due to engagement of lugs 112*a* and 112*b* with J-slot 114. Lugs 112 will be in position C on FIG. 5. Pressure is then increased so that jetting head 20 will again move to its extended position and the reciprocating motion of jetting head 20 causes the engagement of lugs 112*a* and 112*b* with J-slot 114 to rotate jetting head 20 relative to sealed sub 18 to position D which is 90° from the position of jetting head 20 when the lugs are in position B. The treatment process as explained herein can then be performed at the second radial position at zone 124. Such treatment may occur at the same axial position in the well in zone 124 or if desired tool string 16 may be lifted or lowered so that the treatment at the second radial location is axially offset from the treatment at the first radial location. Once the treatment process at the second radial location is complete, pressure can be decreased to allow jetting tool 20 to move to its retracted position. Tool string 16 can then be moved in well 10 to a second desired zone which may be a second zone such as second zone 128 that constitutes either a separate formation or a zone in the same formation in which prior treatment occurred. The treatment process as herein described may be performed at the second and other zones so that stimulation tool 17 may be utilized to perform the method described herein at a plurality of locations in a single well.

As is apparent, jetting tool 20 can be rotated quickly and efficiently to allow treatment at different radial locations in a well. This is an advancement over prior art methods which generally require attempting to rotate the end of a tool by rotating the top of the tool string. Conversely, rotation of the jetting tool 20 described herein occurs with the ratcheting of the tool. The reciprocation of the jetting tool 20 which is translated into rotation by the reaction of lugs 112 with J-slot 114 occurs solely upon the application of hydraulic pressure sufficient to cause the extension of the jetting tool 20 relative to sealed sub 18. In addition to the quick and efficient rotation of the jetting tool 20, wiper seals 66 prevent contamination or at least reduce the possibility of contamination of the sealed sub 18 thus reducing the risk of clogging.

The design and orientation of wiper seals 66 and their relationship to gaps 68 and 109 operate to lessen any risk of contamination. During reciprocation of jetting tool 20, fluid and thus proppant or other debris in well 10 may be drawn into or otherwise may be communicated into channels 58 and 100 through gap 68 at lower end 26 and through gap 109 at upper end 24 of sealed sub 18. Wipers 74 and 76 will wipe stem 42 as it reciprocates in sealed sub 18. In addition, cutaway portion 72 is shaped such that fluid and any proppant or debris that moves into lowermost channel 58 or uppermost channel 100 will be expelled therefrom through gaps 68 and 109, respectively. The reciprocating motion of stem 42 along with the shape of wiper seals 66 cause circulation of any fluid that enters the gaps 68 and 109 to circulate any proppant carried back into well 10 as opposed to contaminating wiper seal 66 and migrating into the oil-filled cavity 46. Wiper seals 66 adjacent the oil-filled cavity 46 are oriented oppositely to help prevent the escape of any oil and to maintain the integrity of oil in the cavity 46.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method for treating a zone intersecting a well comprising the steps of:

lowering a tool string with a jetting tool in the well, wherein a lower end of the jetting tool has a channel capable of drawing in debris and expelling debris therefrom;

positioning the jetting tool at a first longitudinal and a first radial location in the well such that at least one port in the jetting tool for jetting fluid therethrough is adjacent the zone to be treated;

pumping a proppant-laden fluid through the tool string and the at least one port in the jetting tool to initiate fractures at the first longitudinal and first radial location in the well; and ratcheting the jetting tool so the at least one port rotates to a second radial position in the well adjacent the zone to be treated.

2. The method of claim 1, further comprising pumping a proppant-laden fluid through the tool string and the at least one port at the second radial location.

3. The method of claim 1, wherein the pumping step comprises jetting the proppant-laden fluid through the at least one port to perforate a casing in the well at the first longitudinal and first radial location in the well prior to initiating fractures.

4. The method of claim 3, further comprising pumping an annulus fluid in an annulus between the tool string and the well and applying pressure to the annulus, so that the annulus fluid and the proppant-laden fluid from the tool string create and extend fractures in the zone through the perforations.

5. The method of claim 4, wherein the annulus fluid is a clean fluid.

6. The method of claim 4, further comprising displacing a clean fluid into the zone through the tool string and the jetting tool behind the proppant-laden fluid in the tool string.

7. The method of claim 1, wherein the ratcheting step comprises moving the jetting tool axially relative to the tool string, wherein the axial movement causes the jetting tool to rotate relative to the tool string.

8. The method of claim 1, the positioning step comprising after the lowering step, axially extending the jetting tool relative to the tool string, and rotating the jetting tool relative to the tool string.

9. The method of claim 1, the ratcheting step comprising:

axially retracting the jetting tool relative to the tool string by decreasing hydraulic pressure in the tool string and simultaneously rotating the jetting tool; and axially extending the jetting tool relative to the tool string to an extended position by increasing fluid pressure in the tool string and simultaneously rotating the jetting tool to the second radial position.

10. The method of claim 1, further comprising moving the tool in the well to a second longitudinal location in the well adjacent a second zone to be stimulated and repeating the pumping and ratcheting steps.

11. A method of treating a well comprising:

(a) positioning a stimulation tool on a tool string in the well such that ports defined in the stimulation tool are adjacent a first zone to be treated;

(b) axially extending the stimulation tool relative to the tool string and simultaneously rotating the stimulation tool to a first radial position adjacent the first zone;

(c) pumping a proppant-laden fluid through the ports in the stimulation tool to initiate fractures in the first zone;

(d) axially retracting the stimulation tool relative to the tool string;

(e) repeating the step of axially extending the stimulation tool relative to the tool string and simultaneously rotating the stimulation tool to a new radial position adjacent the first zone; and (f) pumping a proppant-laden fluid through the ports in the stimulation tool to initiate fractures in the first zone at the second radial position.

12. The method of claim 11, further comprising positioning the stimulation tool adjacent a second zone to be treated in the well and repeating steps (b), (c), (d), (e) and (f) for the second zone.

13. The method of claim 11, further comprising pumping an annulus fluid in an annulus between the tool string and a casing in the well into the first zone.

14. The method of claim 13, wherein the annulus fluid is selected from the group consisting of a proppant-laden fluid and a clean fluid.

15. The method of claim 11, wherein the stimulation tool comprises:

a sealed sub having a stem slidably disposed therethrough with a jetting head on an end thereof; and a lowermost seal disposed in the channel, the channel being a lowermost channel on the sealed sub, the sealed sub and stem defining a gap therebetween at a lower end thereof which communicates the well with the lowermost channel.

16. The method of claim 15, wherein during the axially extending and retracting steps well debris is communicated into the gap and is expelled therefrom by the lowermost seal.

17. The method of claim 11, the axially extending step comprising applying sufficient hydraulic pressure in the tool string to cause the stimulation tool to axially extend, the axially retracting step comprising reducing the hydraulic pressure in the tool string to automatically axially retract the stimulation tool.

18. A clog-resistant stimulation tool comprising:

a sealed sub;

a stem slidably disposed in the sealed sub;

a jetting head connected to the stem, the stem and jetting head being movable axially and rotationally relative to the sealed sub; and a seal disposed in a lowermost channel on the sealed sub, the sealed sub and stem defining a gap therebetween at a lower end thereof which will communicate a well in which the tool is disposed with the lowermost channel, wherein debris will be drawn into, and expelled from the lowermost channel as the stem moves axially relative to the sealed sub.

19. The clog-resistant stimulation tool of claim 18, further comprising a ratchet coupled to the stem.

20. The clog-resistant tool of claim 19, wherein the ratchet comprises a J-slot and a lug coupled together, the J-slot formed in the stem and the lug affixed to the sealed sub.

21. The clog-resistant stimulation tool of claim 18, wherein the seal in the lowermost channel comprises a lowermost seal, the lowermost seal having an arcuate cutout oriented towards the gap at the lower end of the sealed sub, the tool further comprising an uppermost seal disposed in an uppermost channel defined in the sealed sub, the sealed sub and the stem defining a gap therebetween at the upper end of the sealed sub, the uppermost seal being substantially identical to the lowermost seal and oriented oppositely from the lowermost seal, so that the arcuate cutout in the uppermost seal is oriented towards the gap at the upper end of the sealed sub.

22. The clog-resistant stimulation tool of claim 18, wherein the jetting head will axially extend relative to the sealed sub to an extended position solely upon the application of hydraulic pressure from fluid communicated through the stem to the jetting head, and will automatically axially retract to a retracted position when hydraulic pressure is reduced.

23. The clog-resistant stimulation tool of claim 22, further comprising a spring disposed about the stem, wherein the spring biases the stem towards the retracted position.

24. The clog-resistant stimulation tool of claim 22, wherein as the stem moves axially relative to the sealed sub well debris is drawn into and expelled from the uppermost and lowermost channels through the gaps at the upper and lower ends, respectively, of the sealed sub.

* * * * *